United States Patent [19]

Schwartz

[11] Patent Number: 5,005,840

[45] Date of Patent: Apr. 9, 1991

[54] BINGO GAME WITH INDICIA DISTRIBUTED ON VIDEOCASSETTE

[76] Inventor: David S. Schwartz, 26 Quai Zorn, Strasbourg, France

[21] Appl. No.: 403,613

[22] Filed: Sep. 6, 1989

[51] Int. Cl.[5] ..... A63F 3/00

[52] U.S. Cl. ..... 273/269; 273/237

[58] Field of Search ..... 273/237, 240, 269, DIG. 28

[56] References Cited

U.S. PATENT DOCUMENTS

| | | | |
|---|---|---|---|
| 3,383,792 | 5/1968 | Goldfarb | 273/269 X |
| 3,545,101 | 12/1970 | Fike | 273/269 X |
| 3,549,150 | 12/1970 | Weeks | 273/269 |
| 3,603,592 | 9/1971 | Bury | 273/269 X |
| 4,169,601 | 10/1979 | Frischmann et al. | 273/269 |
| 4,611,811 | 9/1986 | Haase | 273/237 |
| 4,711,454 | 12/1987 | Small | 273/269 |

OTHER PUBLICATIONS

Parker Brothers Products Catalog, 1986, page entitled "VCR GAMES" relied on.

*Primary Examiner*—Edward M. Coven
*Assistant Examiner*—Raleigh W. Chiu
*Attorney, Agent, or Firm*—Merchant, Gould, Smith, Edell, Welter & Schmidt

[57] ABSTRACT

A bingo game having a card distributed with a videocassette. In play, the player matches gaming indicia displayed in the video presentation with the gaming areas on the card.

5 Claims, 2 Drawing Sheets

BINGO GAME WITH INDICIA DISTRIBUTED ON VIDEOCASSETTE

BACKGROUND OF THE INVENTION

The present invention relates to game apparatus and more particularly to a Bingo type game which is used in connection with a mass distribution videocassette publication.

Bingo is a traditional game of chance in which players play markers on a game board. The game board consists of a patterned array of playing areas which are typically squares with numbers within them. The traditional game board is square and has twenty five playing areas arranged in five rows and five columns. Above the top row there is placed the word Bingo with a column under each letter of the word. In play, a caller selects at random, a gaming indicia, and announces the indicia. The gaming indicia are usually numbered balls selected by random removal from a container. The caller announces the number and the players scan their game cards for that number. If the player's card has the number, the player covers the appropriate square with a token. The gaming procedure continues until a player has filled all squares on a row, column, or diagonal of the game board. This player announces that he has "Bingo" and the game is over. The popularity of the game has not been diminished by the passage of time and many improvements have been proposed.

For example, U.S. Pat. No. 4,711,454 has taught the distribution of the game board through the use of a mass distribution publication. In this variant of the Bingo game, the player matches cents-off promotional coupons provided in the publication with the cents-off discounts present on the game card.

The traditional game has also been transported into different gaming media. U.S. Pat. No. 4,611,811 teaches a video game variant of the Bingo game. In this electronic version of the game, the player selects a game card from a plurality of cards presented to him on the video screen. Play begins with a random collection of numbers displayed to the player. The player actuates a switch to select a set of numbers which may be manipulated to form a Bingo combination.

SUMMARY OF THE INVENTION

In contrast to these teachings of the prior art the present invention involves the distribution of a game card in conjunction with a videocassette. The videocassette contains the gaming indicia. The player views the entire videocassette and collects gaming indicia displayed as a video image. A player has won if he can "cover" his game card with the gaming indicia contained in the videocassette distributed with the gaming card.

DETAILED DESCRIPTION OF THE PREFERRED EMBODIMENT

Figure 1:
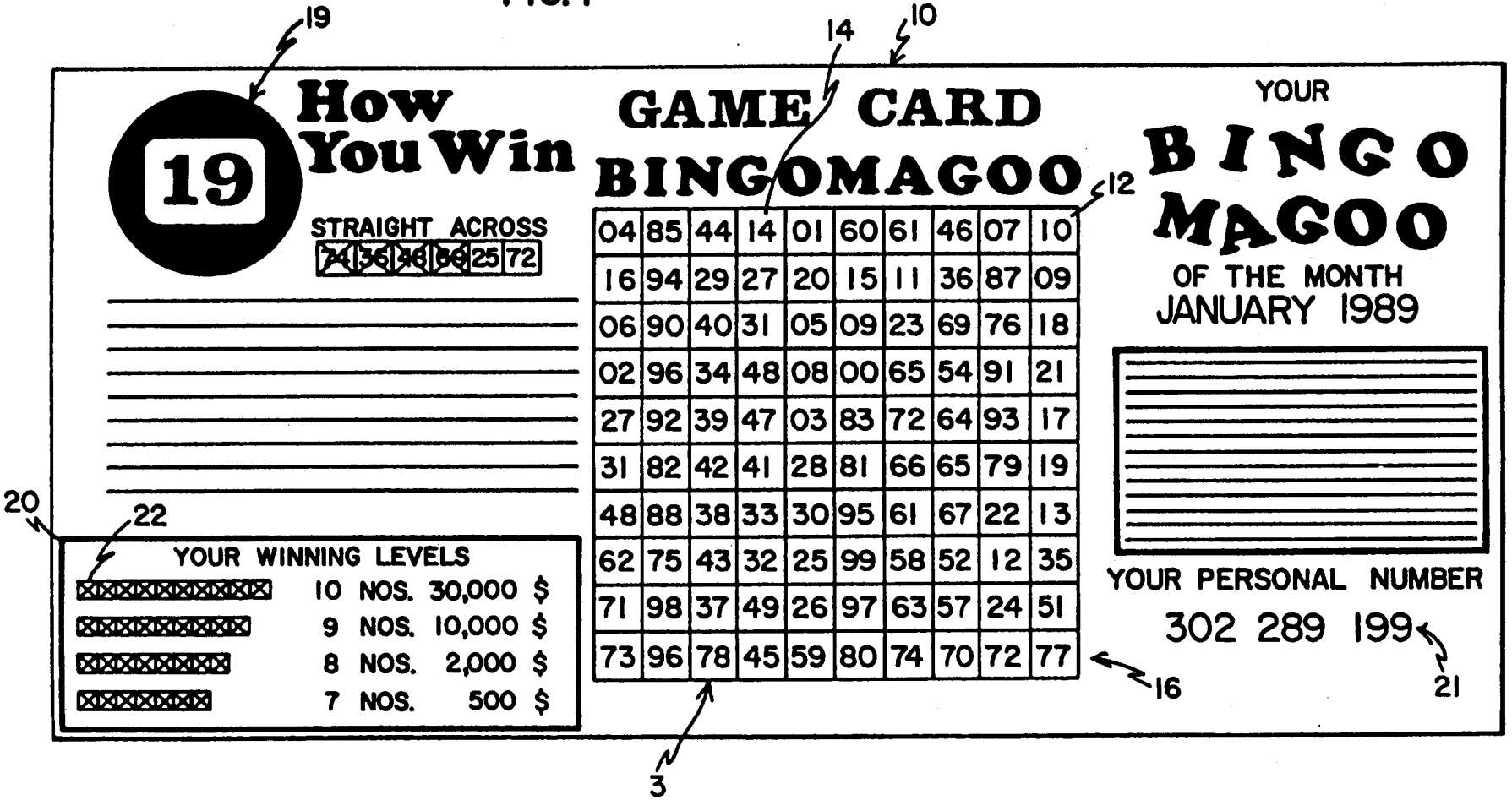
FIG. 1 is a facsimile of an illustrative form that the game card may take.
Figure 2:
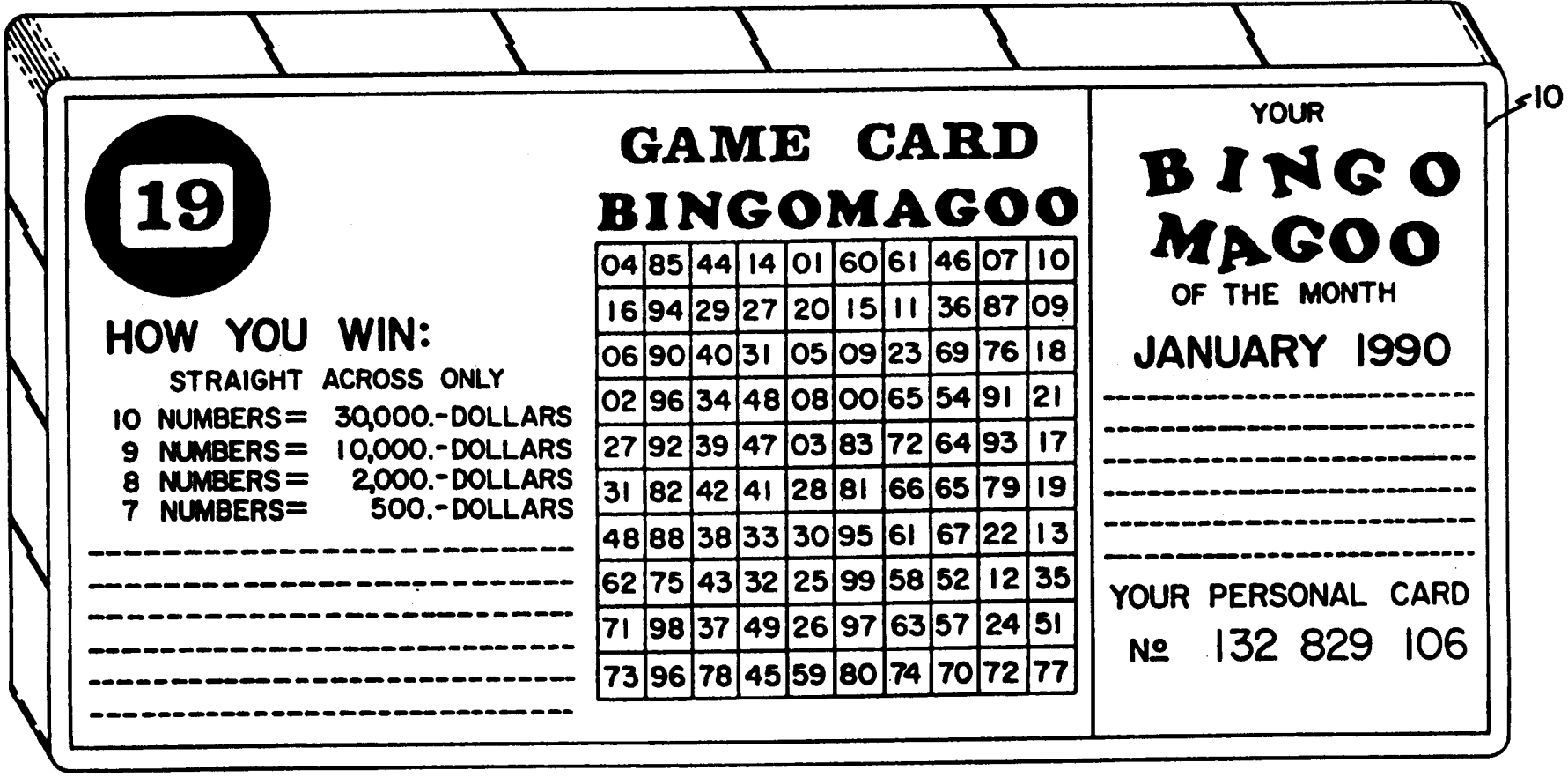
FIG. 2 is an alternate illustrative form that the game card may take.

An illustrative embodiment of the invention will be described in connection with the drawing. It should be clear that many variations and adaptations may be made without departing from the scope of the invention.

It is preferred to distribute the game card 10 with a mass distribution videotape presentation carried on a videotape cassette 11.

The game card 10, shown in the drawing has a matrix of 100 playing areas arranged in a 10×10 array. The word "BINGOMAGOO" is preferably inscribed over the top row, with each letter of the word aligned with a column of the array. This is illustrated at the top of the column labeled 14 where the gaming indicia 14 is located under the letter G. The game card 10 may also carry a unique identifying number to permit verification of the authenticity of the game card and to verify the authority of the wining player to participate in the game.

In play, the player marks his card with a writing instrument when his game card 10 contains a gaming indicia. This process is schematically illustrated in the winning level box 20 by the "x" labeled 22. The gaming numbers or other gaming indicia are embedded in the videocassette information which accompanies the game card.

As is shown in the drawing, gaming indicia may take the form of labeled balls 19 which carry a suitable indicia such as the numeral 19. The indicia may also include color as an element of the indicia as indicated by the dark solid rendering of the "ball" which indicates that the "ball" is colored black.

It is preferred to include various advertising commercials or spots on the video tape and to incorporate or include the gaming indicia or numbers between the advertising segments. It is also possible to merge the gaming indicia with the topical material and to display the gaming indicia simultaneously with the program material. In this fashion the game of Bingomagoo provides an incentive to the viewer to watch the advertising segments on the tape. Given the flexibility of the video tape media it is possible to substitute other indicia for the traditional gaming numbers. The use of colors, numbers, letters, or other visual icons or symbols as the gaming elements are contemplated within the scope of this invention. It is preferred to "flash" these icons on the screen for a brief period of time on the order of one second. However it is possible to utilize other time periods without departing from the scope of the invention.

The viewer is encouraged to view the advertising portion of the tape video by awarding prizes based upon the successful match-up or coverage of the game card. The preferred scoring technique involves adjacent square matches along the rows of the matrix. For example the maximum score would correspond to a completely filled row corresponding to 10 adjacent icons. Lesser scores may be awarded for adjacent square matches of seven or more. It is preferred to distribute advertising segments and the associated game icons throughout the videotape presentation. A typical format for practicing the present invention includes a videocassette magazine which is distributed to subscribers on a periodic basis. The videotape may have 30 minutes of documents or articles, arranged as six segments of five minutes duration each. The advertising may be arranged as six segments of five minutes each with each segment comprising a medley of commercial spots of ten, fifteen ,twenty, or thirty seconds each. A ten second spot may flash a single game icon while a twenty second spot may flash two separate game icons. The game icons may be displayed in conjunction with the word BINGOMAGOO. This format corresponds to a magazine or periodical format. The presence of the game within videotape document discourages the subscriber or viewer from erasing or distributing the videotape and also encourages the subscriber to review the commercial segments of the tape which is desirable.

What is claimed:

1. A game apparatus for use by an individual player comprising:

(a) a planar game card having a matrix of gaming areas, said card distributed on a periodic basis to said player; each of said gaming areas having a single, specific visual gaming indicia located thereon;

(b) a periodic publication presented by videocassette means distributed with said game card on a periodic basis, said videocassette means adapted to present stored images, comprising:

(i) visual gaming indicia stored on said videocassette means, adapted to be flashed to said player; and (ii) audiovisual articles and documents; whereby said player individually and visually matches corresponding and substantially identical ones of said gaming indicia on said gaming card with said corresponding and substantially identical gaming indicia presented by said videocassette means, and whereby the player can repeatedly review the videocassette means to ascertain the correspondence between said indicia displayed by said videocassette means and said indicia on said game card.

2. A game apparatus in accordance with claim 1 wherein said game card comprises: a rectilinear array of rows and columns.

3. A game apparatus for use by an individual player comprising:

(a) a planar game card having gaming areas, said card distributed on a periodic basis to said player, each of said gaming areas containing selected, individual visual gaming indicia located thereon;

(b) a periodic publication presented by videocassette means and distributed with the game card, the videocassette means being adapted to present audiovisual articles, topical advertising material and having corresponding and substantially identical selected visual gaming indicia distributed throughout said topical advertising material which are adapted to be flashed to said player, whereby said player individually and visually locates and matches said gaming indicia located throughout said topical material with said corresponding and substantially identical selected gaming indicia present on said gaming areas during the act of viewing said videocassette means.

4. The game apparatus of claim 3 wherein said gaming indicia are flashed simultaneously with said topical advertising material.

5. The game apparatus of claim 3 wherein said gaming indicia are flashed sequentially with said topical advertising material.

* * * * *